US006181898B1

(12) United States Patent
Sato

(10) Patent No.: US 6,181,898 B1
(45) Date of Patent: Jan. 30, 2001

(54) DEVELOPING APPARATUS

(75) Inventor: Minoru Sato, Toride (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/512,833

(22) Filed: Feb. 25, 2000

(30) Foreign Application Priority Data

Feb. 26, 1999 (JP) ..... 11-050706

(51) Int. Cl.[7] ..... G03G 15/08
(52) U.S. Cl. ..... 399/103; 399/111
(58) Field of Search ..... 399/103, 102, 399/105, 98, 106, 111

(56) References Cited

U.S. PATENT DOCUMENTS 5,930,559 * 7/1999 Kesel ..... 399/103 X
5,937,237 * 8/1999 Nonaka et al. ..... 399/106
6,044,238 * 3/2000 Rodriguez ..... 399/106

* cited by examiner

*Primary Examiner*—Susan S. Y. Lee
(74) *Attorney, Agent, or Firm*—Fitzpatrick, Cella, Harper & Scinto

(57) ABSTRACT

The present invention relates to a developing apparatus which has a developer bearing member for bearing developer to develop an electrostatic image formed on an image bearing member with the developer, a developing frame for supporting the developer bearing member, a developer containing frame containing the developer and having a supply opening for supplying the developer to the developing frame and joined to the developing frame, an unsealable sheet member covering the supply opening, and an elastic seal member provided at a drawing opening portion formed between the developing frame and the developer containing frame and through which the sheet member is drawn. The present invention is featured that the seal member can be urged against the sheet member when the sheet member is drawn and sealing the drawing opening portion after the sheet member was drawn, and a deformed amount of the seal member is varied along a drawing direction of the sheet member.

12 Claims, 10 Drawing Sheets

DEVELOPING APPARATUS

BACKGROUND OF THE INVENTION

1. Field of the Invention

The present invention relates to a developing apparatus for developing an electrostatic image formed on an image bearing member with developer.

The developing apparatus can suitably used with an image forming apparatus or a process cartridge.

The image forming apparatus serves to form an image on a recording material by using an image forming system. As examples of the image forming apparatus, for example, there are an electrophotographic copying machine, an electrophotographic printer (for example, laser printer, LED printer or the like), a facsimile apparatus and a word processor.

The process cartridge may incorporate therein an image bearing member, and at least one of charging means, developing means and cleaning means as a cartridge unit which is detachably attachable to a main body of the image forming apparatus.

2. Related Background Art

Conventionally, in electrophotographic image forming apparatuses using an electrophotographic image forming process, a process cartridge in which an electrophotographic photosensitive drum (image bearing member) and process means acting on the electrophotographic photosensitive drum are integrally incorporated as a cartridge unit which is detachably attachable to a main body of the electrophotographic image forming apparatus has been adopted. According to such a process cartridge system, since the maintenance of the apparatus can be performed by the user or operator himself without any expert, operability is enhanced considerably. Thus, the process cartridge system has widely been used in the electrophotographic image forming apparatuses.

In such a process cartridge, a developer containing frame containing developer (toner) and a developing frame holding a developer bearing member are integrally joined together. By drawing (pulling) out a sheet member covering an opening portion provided on the developer containing frame from an unsealable opening defined between the developer containing frame and the developing frame thereby to unseal the opening portion, developer can be supplied from the developer containing frame to the developing frame. Seal members for preventing leakage of developer and for removing the developer adhered to the sheet member during the pulling of the sheet member are provided at the unsealable opening.

However, in the above-mentioned conventional example, there arise following problems.

If the compressing amount of the elastic seal members is increased at the entire area thereof (i.e., reaction force is increased) in order to enhance the developer removing ability, a pulling force of a tear tape for providing a force for unsealing the sheet member must be increased or the developing frame and the developer containing frame joined together at outer peripheries thereof will be deformed to cause change in dimension, thereby worsening functions of other parts.

Further, at portions of the elastic seal members into which a folded portion of the tear tape and a welded portion to the developer containing frame are penetrated, the elastic seal members are apt to be torn or turned up, with the result that the toner may leak through such a torn or turned up portion.

SUMMARY OF THE INVENTION

The present invention improves the aforementioned conventional technique and an object of the present invention is to provide a developing apparatus in which a developer sweeping ability of a seal member during pulling of a sheet member can be more enhanced.

Another object of the present invention is to provide a developing apparatus in which a sheet member can be pulled out without tearing and turning up a seal member, thereby preventing leakage of developer.

A further object of the present invention is to provide a developing apparatus in which deformation of a developing frame and a developer containing frame due to deformation of a seal member can be prevented.

The other objects and features of the present invention will be apparent from the following detailed explanation referring to the accompanying drawings.

DETAILED DESCRIPTION OF THE PREFERRED EMBODIMENTS

Figure 1:
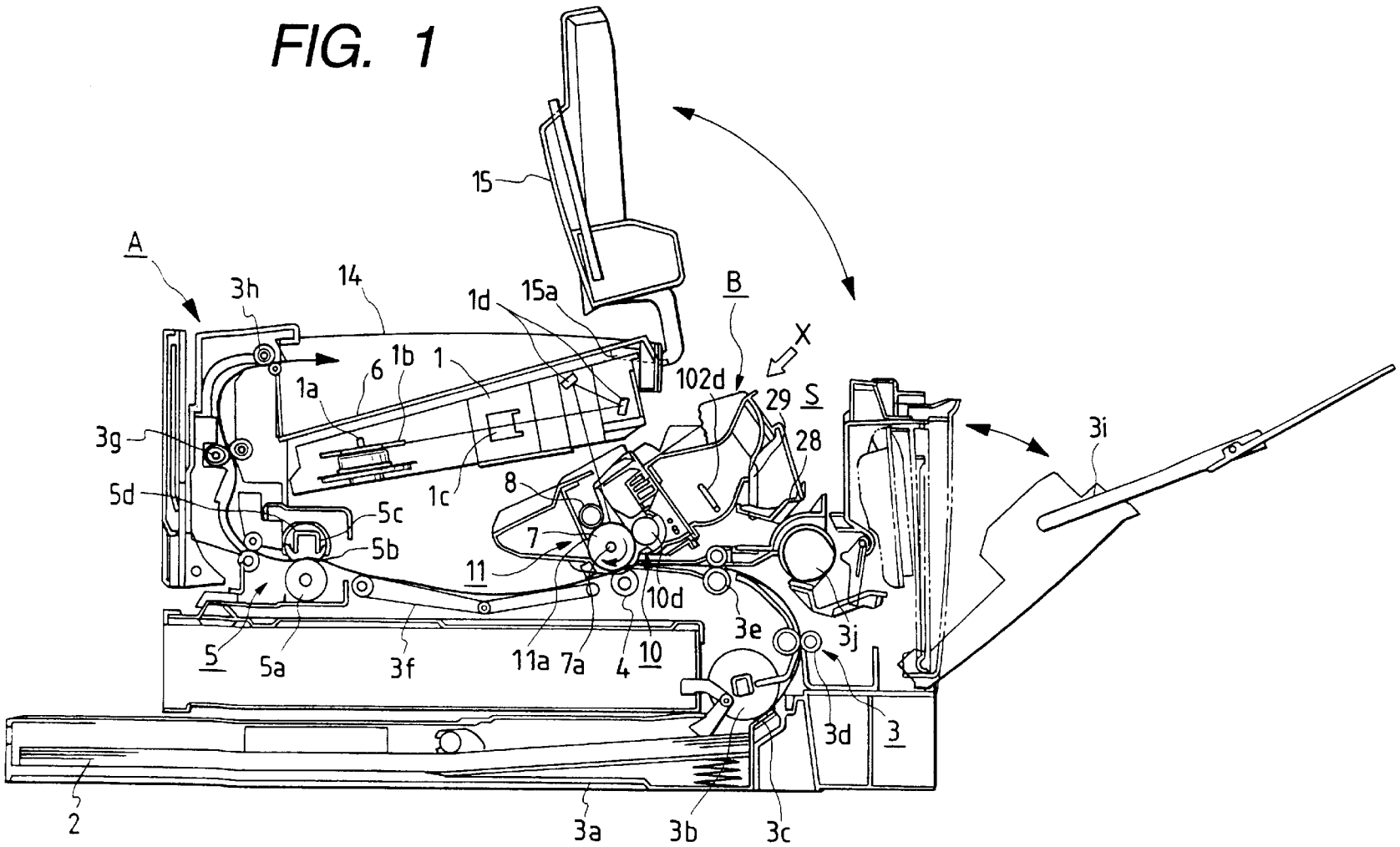
FIG. 1 is a schematic sectional view of an electrophotographic image forming apparatus to which a process cartridge according to an embodiment of the present invention is mounted.

I. Schematic constructions of electrophotographic image forming apparatus and process cartridge First of all, an electrophotographic image forming apparatus according to an embodiment of the present invention will be described with reference to FIG. 1. FIG. 1 is a schematic constructural view of an electrophotographic image forming apparatus (laser beam printer) to which a process cartridge according to an embodiment of the present invention is mounted.

As shown in FIG. 1, in the electrophotographic image forming apparatus A, information light (laser beam) corresponding to image information from an optical system 1 is illuminated onto a photosensitive drum (drum-shaped image bearing member) 7 of a process cartridge B, thereby forming a latent image. The latent image is developed by developer (referred to as "toner" hereinafter) to form a toner image. In synchronous with formation of the toner image, recording materials (for example, recording papers) 2 are separated and fed one by one from a sheet feeding cassette 3*a* by means of a pick-up roller 3*b* and an urging member 3*c* urged against the pick-up roller and the separated recording material is conveyed by conveying means 3 comprised of a pair of convey rollers 3*d* and a pair of registration rollers 3*e*. By applying voltage to a transfer roller (transfer means) 4, the toner image formed on the electrophotographic photosensitive member of the process cartridge B is transferred onto the recording material 2. Then, the recording material 2 is conveyed to fixing means 5 by a conveying belt 3*f*. The fixing means 5 comprise a driving roller 5*a*, and a fixing rotary member (cylindrical sheet) 5*d* having a heater 5*b* therein and rotatably supported by a support 5*c*, so that, by applying the recording material 2 passed through the fixing means, the transferred toner image is fixed to the recording material. Thereafter, the recording material 2 is conveyed by pairs of discharge rollers 3*g*, 3*h* and then is discharged onto a discharge portion 6 through a turn-over conveying path.

On the other hand, in the process cartridge B, the photosensitive drum 7 having a photosensitive layer is being rotated, the surface of the photosensitive drum 7 is uniformly charged by applying voltage to a charging roller (charging means) 8, and the charged photosensitive drum 7 is exposed by light image (information light) emitted from the optical system 1 and passing through an exposure opening portion 9, thereby forming a latent image. The latent image is developed by developing means 10 to form a toner image. After the toner image was transferred to the recording material 2, residual toner remaining on the surface of the photosensitive drum 7 is removed by cleaning means 11.

Incidentally, in the electrophotographic image forming apparatus A, a manual sheet insertion (manual sheet feeding) can also be effected by using a foldable manual insertion tray 3*i* rotatably attached to a main body of the electrophotographic image forming apparatus (printer body; referred to as "main body of the image forming apparatus" hereinafter) and a roller 3*j*. Further, the process cartridge B can detachably be mounted to cartridge mounting guides (cartridge mounting means) (not shown) provided on both sides (both sides in a direction of an axis 7*a* of the photosensitive drum 7) of a cartridge mounting portion S, by opening an opening member 15 rotatably attached to an upper part of the main body 14 of the image forming apparatus via a shaft 15*a* and by inserting the process cartridge into the cartridge mounting portion S of the main body 14 of the image forming apparatus from a direction shown by the arrow X. In FIG. 1, the optical system 1 includes a laser beam source 1*a*, a polygon mirror 1*b*, a lens 1*c* and reflection mirrors 1*d*.

II. Housing structure and internal structure of process cartridge

Figure 2:
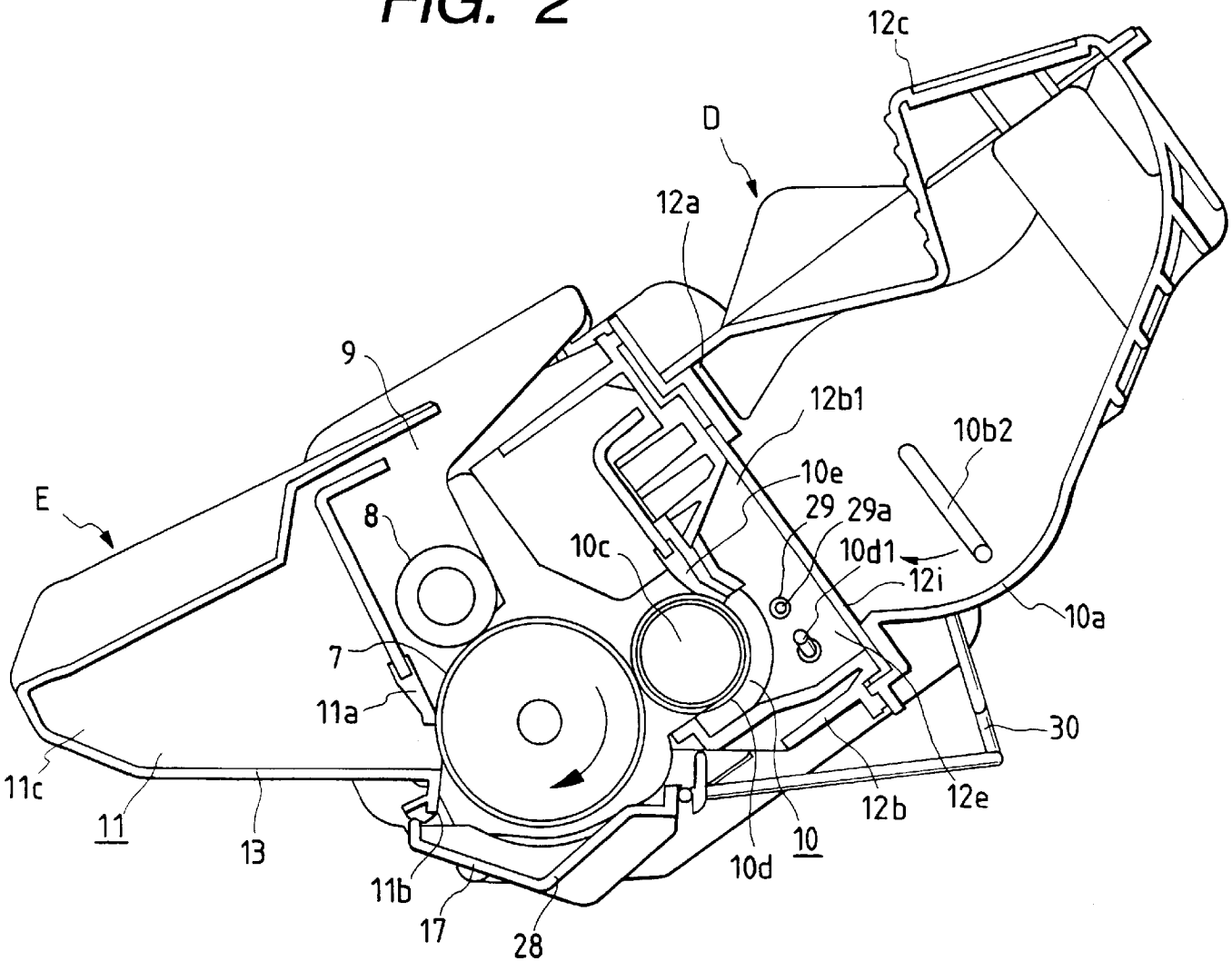
FIG. 2 is a sectional view of the process cartridge.

Next, a housing structure and internal structure of the process cartridge B will be described with reference to FIG. 2. FIG. 2 is a side sectional view of the process cartridge according to the illustrated embodiment.

In the process cartridge B, a developing unit (developing apparatus) D is constituted by integrally joining a toner frame (developer containing frame) 12*a* comprised of a lid member 12*c* and a toner containing portion 10*a* containing the toner to a developing frame 12*b* holding the developing means 10 such as a developing roller (developer bearing member) 10*d*. Further, the photosensitive drum 7, the charging roller 8 and the cleaning means 11 including a cleaning blade 11*a* are attached to a cleaning frame 13, thereby forming a cleaning unit E. The process cartridge B obtained by rotatably joining the developing unit D and the cleaning unit E together can be detachably attachable to the main body 14 of the image forming apparatus and the cartridge mounting guides (mounting means; not shown) of the main body 14 of the image forming apparatus by the operator.

The process cartridge B is provided with the exposure opening portion 9 through which the information light corresponding to the image information is illuminated onto the photosensitive drum 7, and a transfer opening portion 17 through which the photosensitive drum 7 is opposed to the recording material 2. More specifically, the exposure opening portion 9 is formed in the cleaning frame 13 and the transfer opening portion 17 is defined between the developing frame 12*b* and the cleaning frame 13.

In the process cartridge B according to the illustrated embodiment, as mentioned above, a housing constituted by rotatably joining the developing unit D comprised of the toner frame 12*a* and the developing frame 12*b* to the cleaning frame 13 contains therein the photosensitive drum 7, charging roller 8, developing means 10 and cleaning means 11 and is detachably attachable to the main body 14 of the image forming apparatus. A drum shutter member 28 is rotatably attached to the developing unit D via a linkage 30. The drum shutter member 28 serves to cover the photosensitive drum 7 when the process cartridge B is dismounted from the main body 14 of the image forming apparatus, thereby preventing the photosensitive drum from being exposed to the light for a long time or preventing the photosensitive drum from being contacted with foreign matters.

The developing means 10 are supported by the developing unit D. The developing means 10 comprise a toner feeding member (toner feeding means) 10*b*2, the developing roller 10*d*, a toner agitating member 10*d*1 and a developing blade 10*e*. The toner feeding member 10*b*2 is rotatably supported within a toner containing portion 10*a* of the toner frame 12*a* of the developing unit D. The developing roller 10*d* and the toner agitating member 10*d*1 are rotatably supported within a developing chamber 12*b*1 of the developing frame 12*b*. The developing blade 10*e* is fixedly supported within the developing chamber 12*b*1 of the developing frame 12*b* and is contacted with the developing roller 10*d*. In the developing means 10, by rotating the toner feeding member 10*b*2, the toner in the containing portion 10*a* is fed out into the developing frame 12*b* through an opening portion 12*i* of the toner frame 12*a* and an opening portion 12*e* of the developing frame 12*b*, and the toner is agitated by the toner agitating member 10*d*1. When the developing roller 10*d* having a fixed magnet 10*c* therein is rotated, a toner layer which is frictionally charged by the developing blade 10*e* is formed on the surface of the developing roller 10*d*. By transferring the toner layer onto the latent image on the photosensitive drum 7, the latent image on the photosensitive drum 7 is visualized as the toner image.

The cleaning unit E supports the photosensitive drum 7, charging roller 8 and cleaning means 11. The photosensitive drum 7 and the charging roller 8 rotatably supported by the cleaning frame 13 and are contacted with each other. The cleaning means 11 comprise a cleaning blade 11*a*, a dip (scoop) sheet 11*b*, and a removed toner containing portion 11*c*. The cleaning blade 11*a* is fixedly supported by the cleaning frame 13 and is contacted with the photosensitive drum 7. The dip sheet 11*b* is secured to the cleaning frame 13 below the cleaning blade 11*a*. In the cleaning means 11, after the toner image was transferred to the recording material 2 by applying voltage having polarity opposite to polarity of the toner image on the photosensitive drum 7 to the transfer roller 4 within the main body 14 of the image forming apparatus, the residual toner remaining on the photosensitive drum 7 is scraped off by the cleaning blade 11*a,* and the scraped toner is scooped by the dip sheet 11*b* and then is collected into the removed toner containing portion 11*c*. In this way, the residual toner is removed from the photosensitive drum 7.

Incidentally, the developing frame 12*b* of the developing unit D is provided with toner amount detecting means 29. The toner amount detecting means 29 has an antenna wire 29*a* extending in parallel with the developing roller 10*d* in the toner supplying path from the toner containing portion 10*a* of the toner frame 12*a* to the developing roller 10*d* within the developing chamber 12*b*1. The toner amount detecting means 29 detects change in electrostatic capacity between the antenna wire 29*a* and the developing roller 10*d* when voltage is applied to the developing roller 10*d,* thereby detecting the toner remaining amount. That is to say, by utilizing a phenomenon that if there is the toner between the antenna wire 29*a* and the developing roller 10*d* the electrostatic capacity therebetween becomes small and if there is no toner between the antenna wire 29*a* and the developing roller 10*d* the electrostatic capacity therebetween becomes great, the toner amount is detected. In this way, no toner condition can be judged. More specifically, the fact that the toner remaining amount reaches a predetermined value is judged. Incidentally, the judgement of the toner amount detection is effected whenever each electrophotographic image forming process is finished.

III. Joining structure between developing unit and cleaning unit

Figure 3:
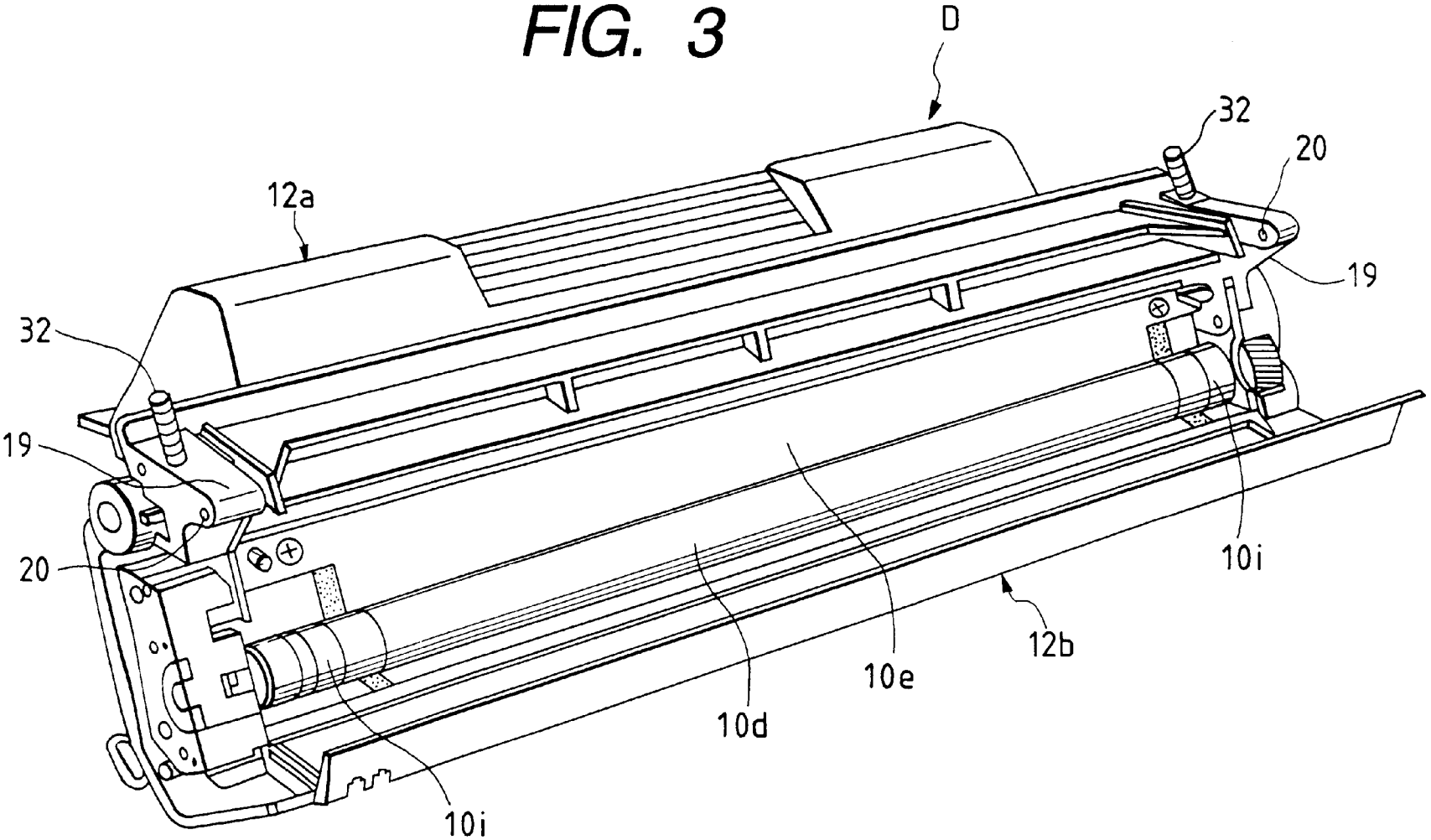
FIG. 3 is a view showing a developing unit of the process cartridge, looked at from a developing roller side.
Figure 4:
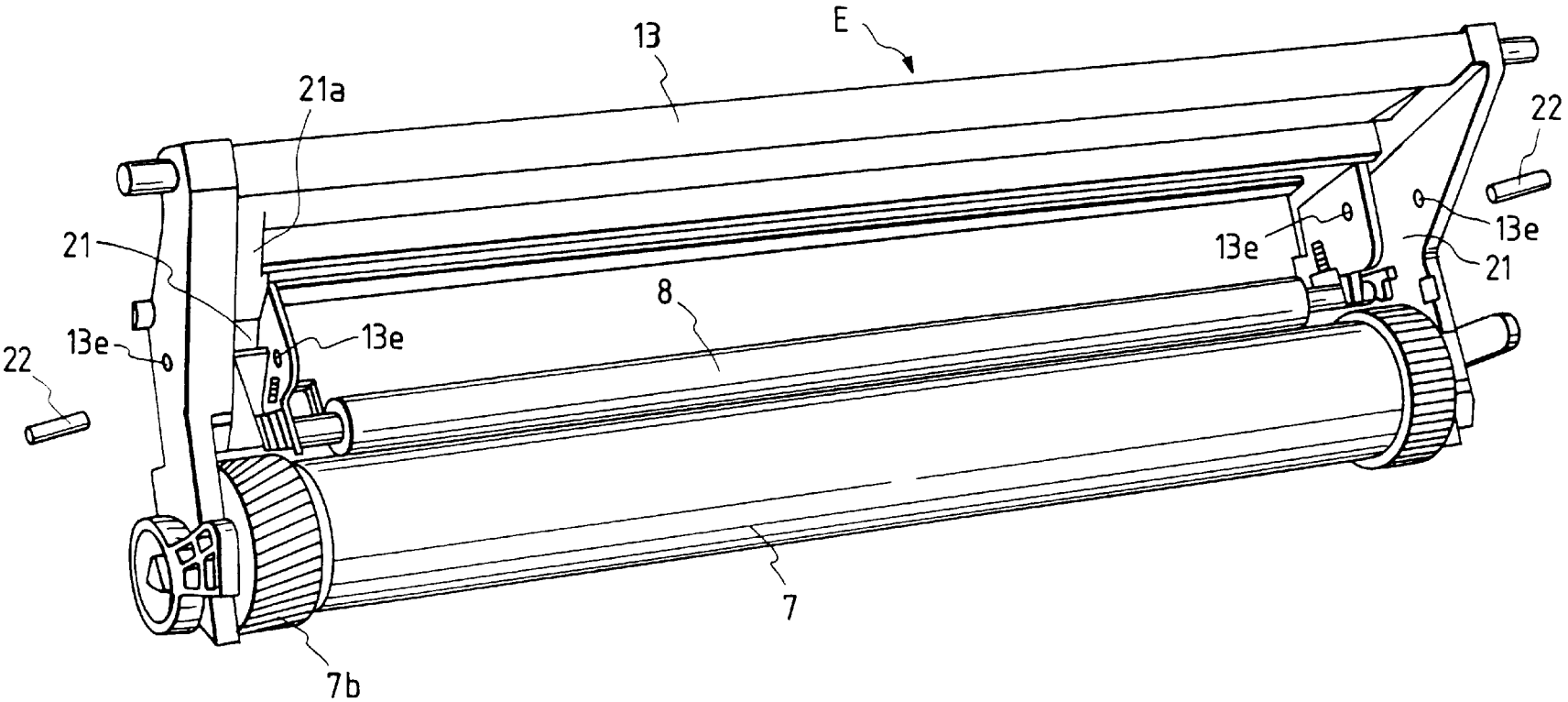
FIG. 4 is a view showing a cleaning unit of the process cartridge, looked at from a photosensitive drum side.

Next, a joining structure between the developing unit D and the cleaning unit E will be described with reference to FIGS. 3 and 4. FIG. 3 is a perspective view of the developing unit, looked at from a developing roller side, and FIG. 4 is a perspective view of the cleaning unit, looked at from the photosensitive drum side.

The developing unit D and the cleaning unit E are rotatably joined together by cylindrical pin joining members 22 (FIG. 4) to form the process cartridge B. That is to say, as shown in FIG. 3, circular rotary holes 20 extending in parallel with the developing roller 10*d* are formed in tip end portions of arm portions 19 formed on both longitudinal (longitudinal direction of the developing roller 10*d*) ends of the developing frame 12*b*. On the other hand, as shown in FIG. 4, two recessed portions 21 for receiving the arm portions 19 are formed in both longitudinal ends of the cleaning frame 13. By inserting the arm portions 19 into the recessed portions 21 and by press-fitting the connection members 22 into attachment holes 13*e* of the cleaning frame 13 and into the circular rotary holes 20 of the arm portions 19 and further into inner attachment holes 13*e,* the developing unit D and the cleaning unit E are joined together rotatably around the connection members 22. In this case, compression coil springs 32 mounted around joggles (not shown) formed on roots of the arm portions 19 abut against upper walls 21*a* of the recessed portions 21 of the cleaning frame 13 so that the developing frame 12*b* is biased downwardly by the compression coil springs 32, thereby positively urging the developing roller 10*d* against the photosensitive drum 7. Incidentally, upper walls 21*a* of the recessed portions 21 of the cleaning frame 13 are inclined so that, as the developing unit D and the cleaning unit E are assembled together, the compression coil springs 32 are gradually compressed from a relax condition. Accordingly, as shown in FIG. 3, by attaching spacer sub-rollers 10*i* (having a larger diameter than that of the developing roller 10*d*) to both longitudinal ends of the developing roller 10*d,* the spacer sub-rollers 10*i* are urged against the photosensitive drum 7, with the result that the photosensitive drum 7 is opposed to the developing roller 10*d* with a predetermined gap (about 300 μm) therebetween. With this arrangement, the developing unit D and the cleaning unit E can be rotated relative to each other around the connection members 22, with the result that a positional relationship between the peripheral surface of the photosensitive drum 7 and the peripheral surface of the developing roller 10*d* can be maintained by the elastic forces of the compression coil springs 32.

IV. Driving of process cartridge

According to the process cartridge B constructed in this way, within the housing forming the cartridge frame, the photosensitive drum 7, toner feeding member 10*b*2 of the developing means 10, developing roller 10*d* and toner agitating member 10*d*1 are connected to each other via a gear mechanism (not shown) so that these elements can be operated in a synchronous manner. When the process cartridge B is mounted to the cartridge mounting portion S of the main body 14 of the image forming apparatus, a driven gear 7*b* (FIG. 4) provided a longitudinal end of the photosensitive drum 7 and forming a part of the gear mechanism is engaged by a drive gear (not shown) of the main body 14 of the image forming apparatus, with the result that, when the drive gear is rotated by a main motor (not shown) within the main body 14 of the image forming apparatus, the driven gear 7*b* of the photosensitive drum 7 is rotated, thereby rotating the toner feeding member 10*b*2, developing roller 10*d* and toner agitating member 10*d*1.

Incidentally, the process cartridge B is provided with a grounding contact for the photosensitive drum 7, a charge bias contact for the charging roller 8, a developing bias contact for the developing roller 10*d* and a toner amount detecting contact for the toner amount detecting means 29, which contacts (not shown) are provided on the surface of the housing at predetermined positions. When the process cartridge B is mounted to the cartridge mounting portion S of the main body 14 of the image forming apparatus, these electrical contacts are electrically connected to corresponding electrical contacts (not shown) of the main body 14 of the image forming apparatus.

Figure 5:
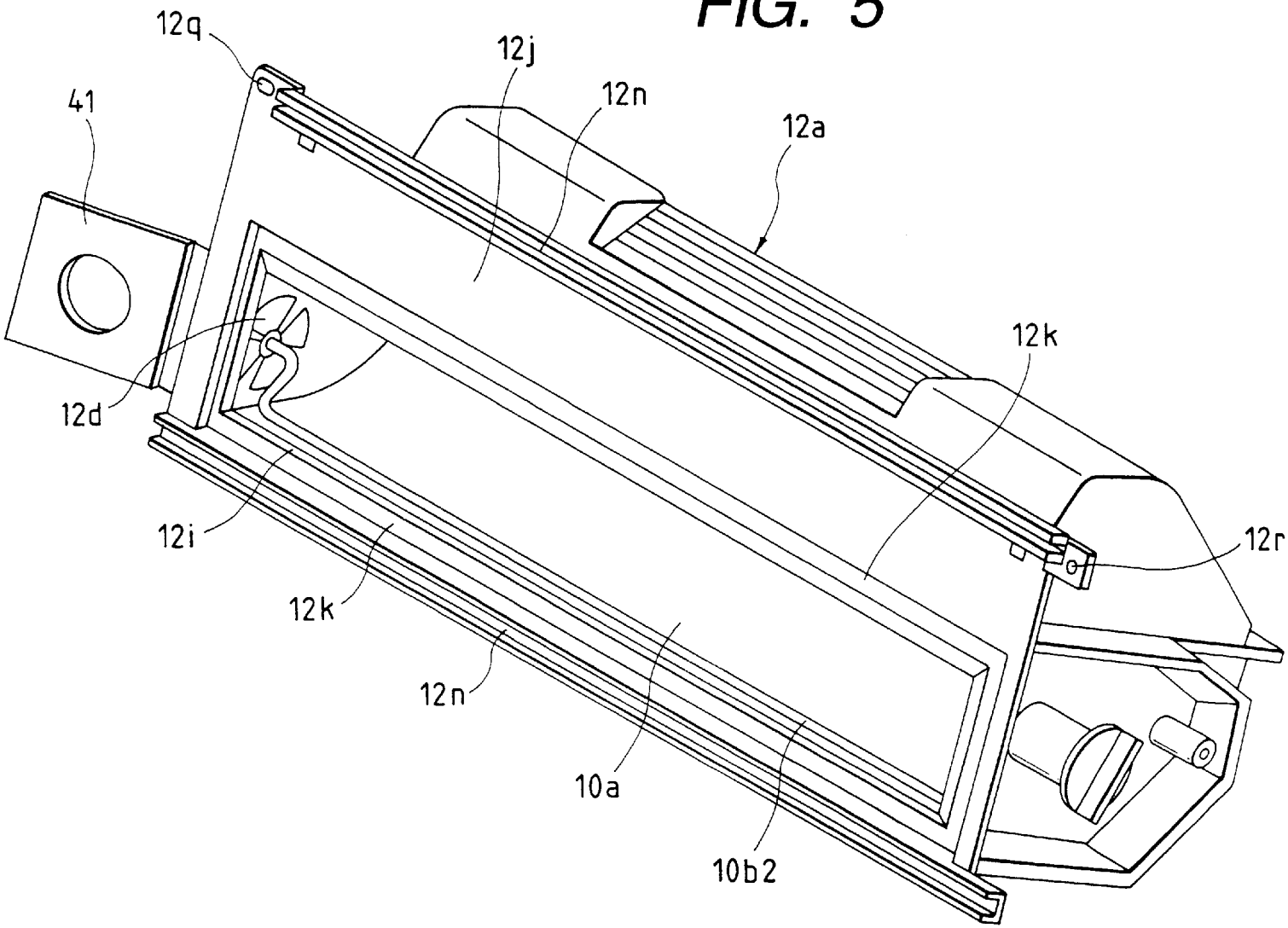
FIG. 5 is a view showing a toner frame of the process cartridge, looked at from an opening side.

V. Construction of joining portion between developing frame and toner frame of developing unit Next, a construction of the joining portion between the developing frame 12*b* and the toner frame 12*a* of the developing unit D will be described with reference to FIGS. 5 to 7. FIG. 5 is a perspective view of the toner frame, looked at from a developing frame side, FIG. 6 is a perspective view showing a condition that a cover film is attached to the toner frame, and FIG. 7 is a perspective view of the developing frame, looked at a toner frame side.

As shown in FIG. 5, a surface of the toner frame 12*a* opposed to the developing frame 12*b* is provided with a supply opening portion 12*i* for feeding out the toner from the toner containing portion 10*a* to the developing frame 12*b,* a recessed surface 12*k* provided around the opening portion 12*i,* and a flat flange (joining portion or interface) 12*j* provided around the recessed surface 12*k*. The flange 12*j* is provided at its upper and lower edges with longitudinal (axial direction of the photosensitive drum 7) and parallel grooves (recesses) 12*n*.

Figure 6:
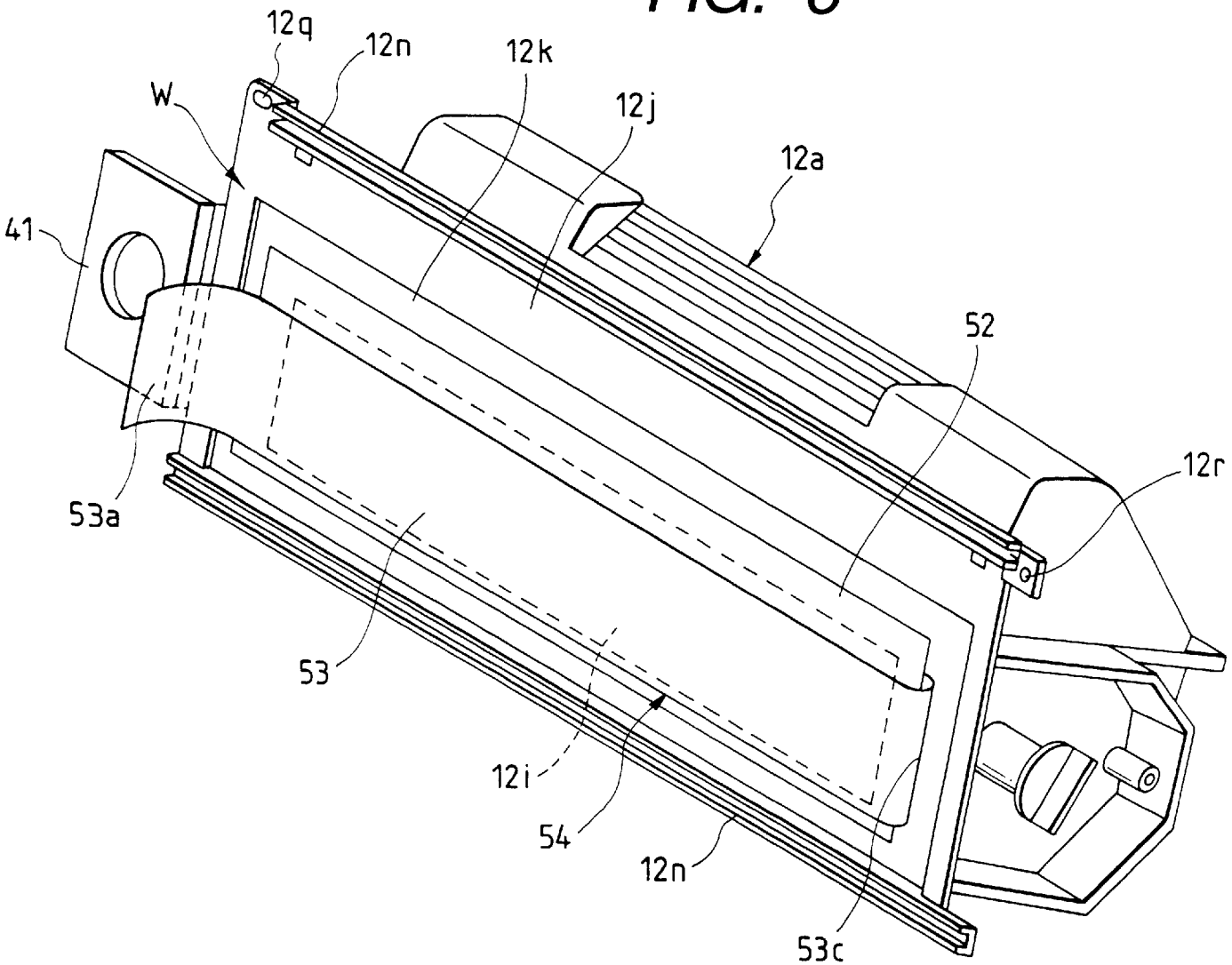
FIG. 6 is a view showing a condition that a cover film and a tear tape are attached to the toner frame of the process cartridge.

A cover film (sheet member) 52 which can easily be torn in the longitudinal direction is adhered to the recessed surface 12*k* of the toner frame 12*a* to sealingly close the opening portion 12*i* of the toner frame 12*a* before the toner frame is joined to the developing frame 12*b* (FIG. 6). As shown in FIG. 6, at the recessed surface 12*k* of the toner frame 12*a*, the cover film 52 is adhered to the toner frame 12*a* along the periphery of the opening portion 12*i*. A tear tape 53 for tearing the cover film 52 to unseal the opening portion 12*i* is welded to the cover film 52. The tear tape 53 is folded at one longitudinal end of the opening portion 12*i* and extends, from one end 53*c*, through between the toner frame 12*a* and an elastic seal material (seal member having elasticity; FIG. 7) 47, at the opposite side of one end 53*c*, adhered to a longitudinal end of a flange 12*u* (described later) of the developing frame 12*b* opposing to the flange 12*j* of the toner frame 12*a* and terminates as the other end 53*a* (extending out of the cartridge). The other end 53*a* of the tear tape 53 is attached to a grip 41 integrally formed with the toner frame 12*a* (FIGS. 6 and 7). The grip 41 can easily be separated from the toner frame 12*a* because of provision of a weakened portion between the grip and the toner frame.

Figure 7:
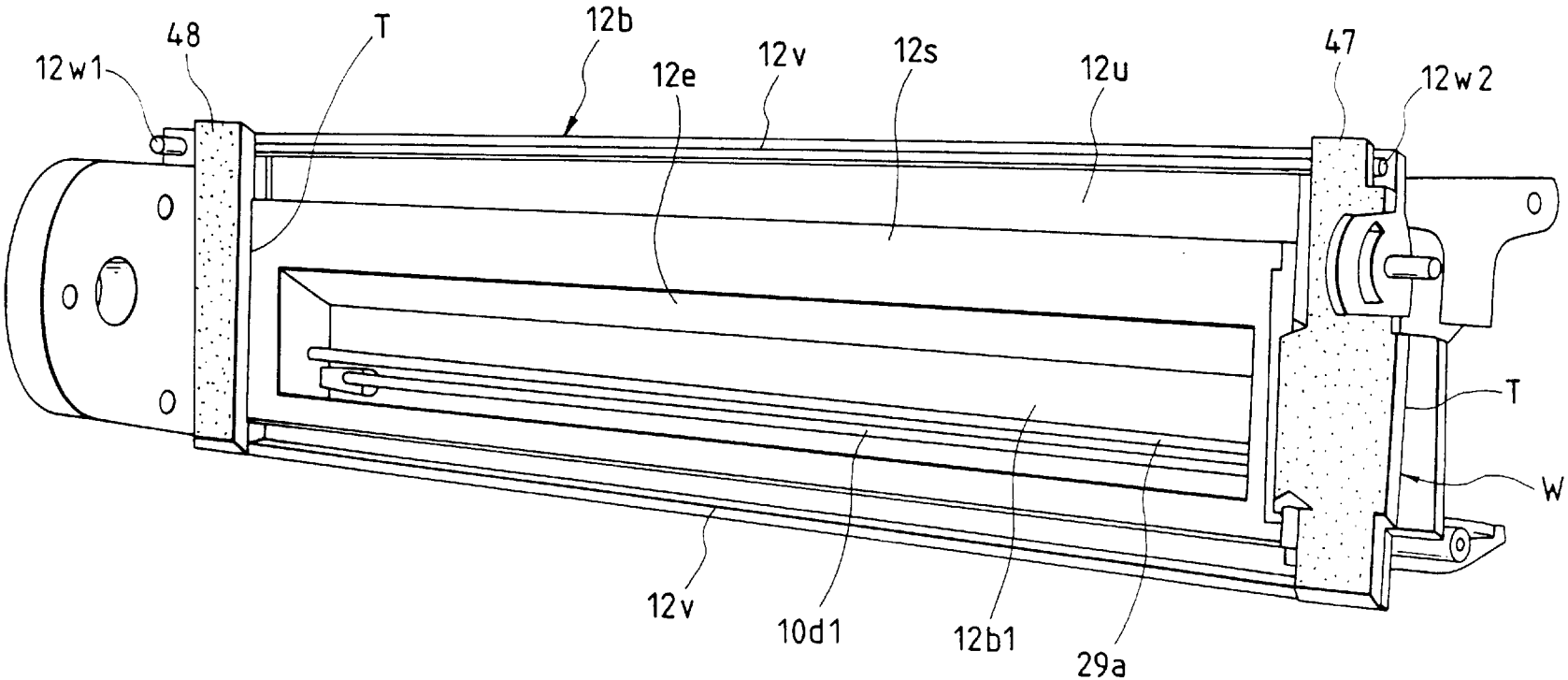
FIG. 7 is a view showing a developing frame of the process cartridge, looked at from a toner frame side.
Figure 8:
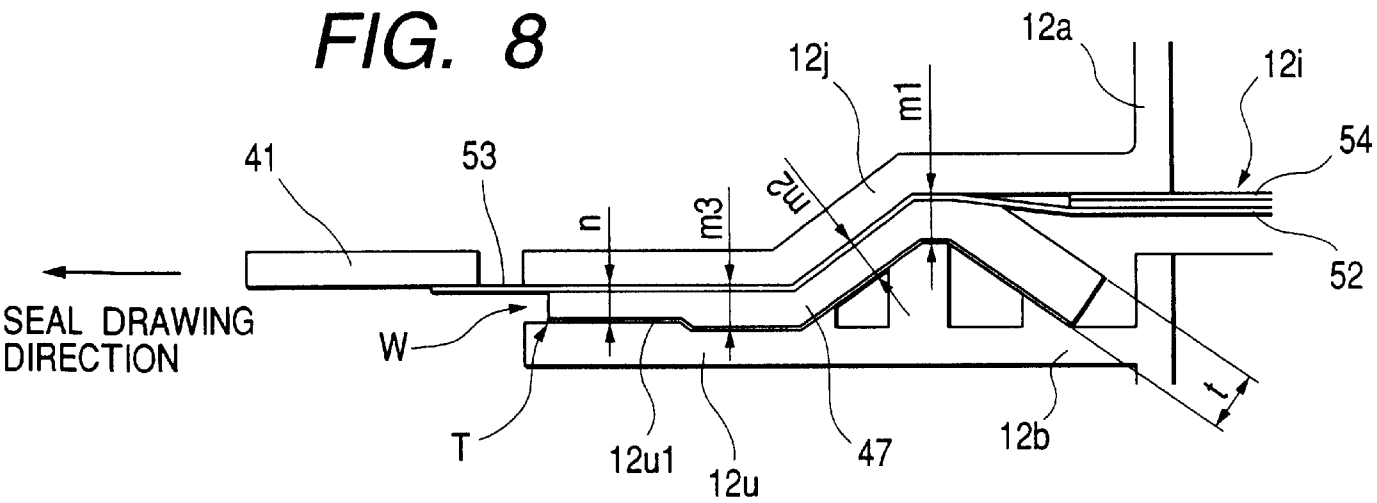
FIG. 8 is a sectional view showing an unsealable opening portion of the process cartridge before the tear tape is pulled out.
Figure 9:
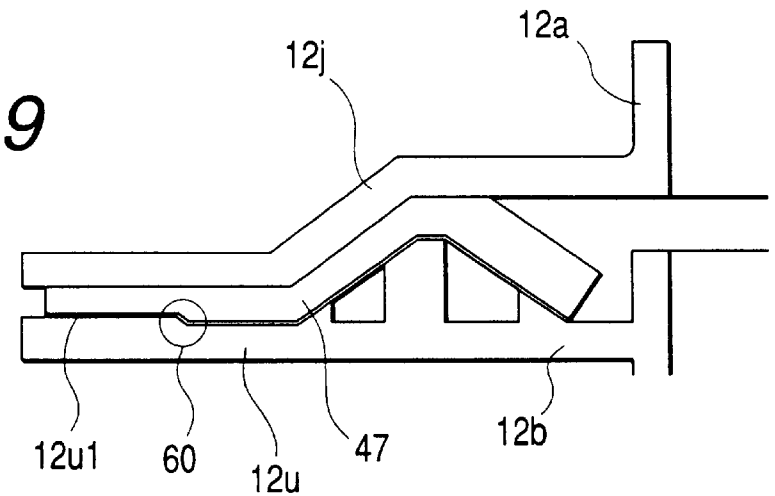
FIG. 9 is a sectional view showing the unsealable opening portion of the process cartridge after the tear tape is pulled out.

As shown in FIG. 7, a surface of the developing frame 12*b* opposed to the toner frame 12*a* is provided with an opening portion 12*e* for introducing the toner from the toner frame 12*a* to the developing chamber 12*b*1, a protruded surface 12*s* provided around the opening portion 12*e* and adapted to be fitted into the recessed surface 12*k* of the toner frame 12*a*, and a flat flange (joining portion or interface) 12*u* provided around the protruded surface 12*s*. The flange 12*u* is provided at its upper and lower edges with longitudinal (axial direction of the photosensitive drum 7) and parallel ridges (protruded portions) 12*v*. The ridges 12*v* can be fitted into the grooves 12*n* of the toner frame 12*a* with any play and are provided at their top surfaces with triangular protrusions (not shown) which are welded to the bottoms of the grooves 12*n* of the toner frame 12*a* when the toner frame and the developing frame are joined together by ultrasonic welding.

The elastic seal material (seal member) 47 made of felt or foam rubber is adhered to the longitudinal end of the flange 12*u* of the developing frame 12*b*. When the toner frame 12*a* and the developing frame 12*b* are integrally joined, the elastic seal material 47 serves to sealingly close a drawing opening portion (tear tape drawing opening) W (FIGS. 6, 7) formed between the flanges 12*j* and 12*u* near the other end 53*a* of the tear tape 53. Further, an elastic seal material 48 made of material same as that of the elastic seal material 47 is adhered to the flange 12*u* of the developing frame 12*b* at a longitudinal end thereof opposite to the elastic seal material 47.

The elastic seal materials 47, 48 are adhered to both longitudinal ends of the flange 12*u* of the developing frame 12*b* along the entire width (up-and-down direction) thereof by both-face adhesive tapes (both-face adhesive members). The elastic seal materials 47, 48 coincide with portions of the flange 12*j* at both longitudinal ends of the recessed surface 12*k* of the toner frame 12*a* and are overlapped with the ridges 12*v* of the developing frame 12*b* at entire width of the flange 12*j*.

Furthermore, when the toner frame 12*a* and the developing frame 12*b* are joined together, in order to facilitate alignment between the frames 12*a*, 12*b*, a circular hole 12*r* and a rectangular hole 12*q* are formed in the flange 12*j* of the toner frame 12*a* and a cylindrical joggle 12*w*1 and a prismatic joggle 12*w*2 (which are to be fitted into the circular hole 12*r* and the rectangular hole 12*q* of the toner frame 12*a*) are formed in the developing frame 12*b*. In this case, the circular hole 12*r* is closely fitted on the cylindrical joggle 12*w*1, and the rectangular hole 12*q* is fitted onto the prismatic joggle 12*w*2 closely in a width-wise direction but with play in a longitudinal direction.

VI. Joining toner frame and developing frame

Before the toner frame 12*a* and the developing frame 12*b* are joined together, the toner frame 12*a* and the developing frame 12*b* are assembled as independent units. When assembled, after the opening portion 12*i* of the toner frame 12*a* is sealingly closed by the cover film 52 and the tear tape 53 of the sealing member 54, toner is loaded through a toner loading opening 12*d* (FIG. 5), and the toner loading opening 12*d* is closed by a toner cap (not shown). Thereafter, the positioning cylindrical joggle 12*w*1 and prismatic joggle 12*w*2 of the developing frame 12*b* are fitted into the positioning circular hole 12*r* and rectangular hole 12*q* of the toner frame 12*a*. Further, the ridges 12*v* of the developing frame 12*b* are fitted into the grooves 12*n* of the toner frame 12*a*. Then, when the developing frame 12*b* is urged against the toner frame 12*a*, the elastic seal materials 47, 48 are compressed (in a thickness direction) against the flange at both longitudinal ends thereof.

In this condition, when ultrasonic vibration is applied between the ridges 12*v* and the grooves 12*n*, the triangular projections on the ridges 12*v* are melted and are welded to the bottoms of the grooves 12*n*. In this way, the toner frame 12*a* and the developing frame 12*b* are joined together. In this case, a space longitudinal peripheral edges of which are closed is defined between the recessed surface 12*k* of the toner frame 12*a* and the flange portion 12*u* of the developing frame 12*b* opposed to the recessed surface 12*k*. The cover film 52 and the tear tape 53 are contained in this space. In this way, the developing unit D as shown in FIG. 3 is completed.

VII. Toner leakage preventing mechanism at drawing opening portion

Figure 11:
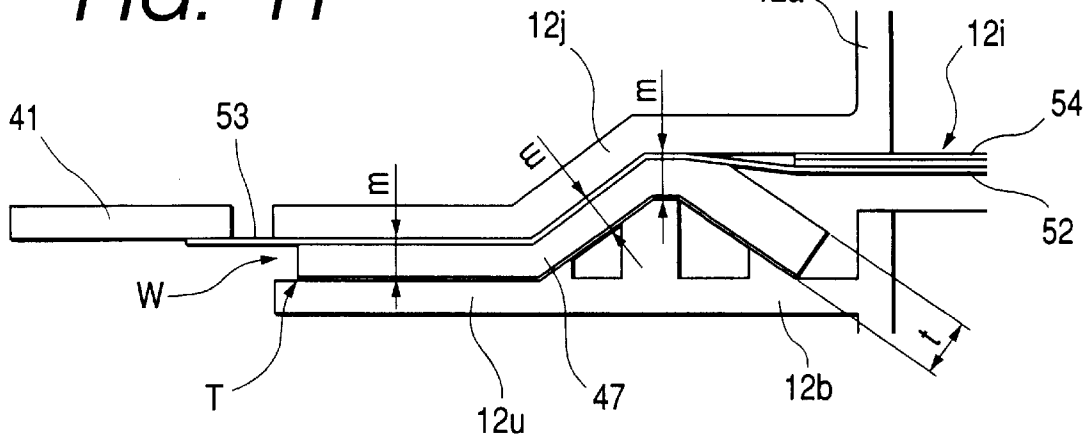
FIG. 11 is a sectional view showing an unsealable opening portion of a conventional process cartridge before a tear tape is pulled out.
Figure 12:
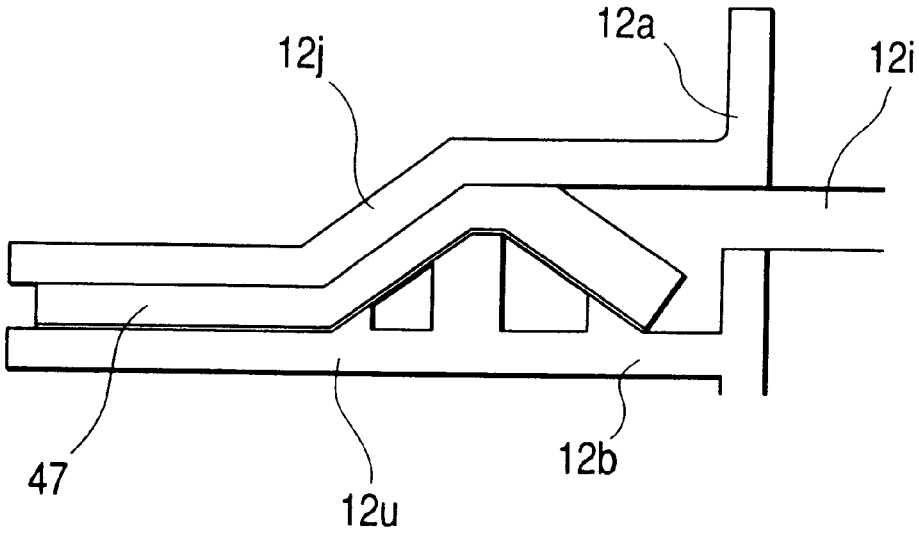
FIG. 12 is a sectional view showing the unsealable opening portion of the conventional process cartridge after the tear tape is pulled out.

Now, a toner leakage preventing mechanism at the drawing opening portion W will be further fully described with reference to FIGS. 11 and 12.

As mentioned above, the toner frame 12*a* containing the toner and the developing frame 12*b* supporting the developing means 10 are joined together at the upper and lower ends of the flanges 12*j*, 12*u* along the longitudinal direction. At the opening portion 12*i* provided on the toner frame 12*a*, the sealing member 54 comprised of the cover film 52 for closing the opening portion 12*i* and the tear tape 53 for tearing the cover film is thermally welded to the toner frame 12*a*. The tear tape 53 is folded at its longitudinal (left-and-right direction) one end 53c (FIG. 6) and extends through the drawing opening portion W and is secured to the grip 41 of the toner frame 12*a* by a both-face adhesive tape. When the grip 41 is separated from the toner frame 12*a* and is pulled toward a direction shown by the arrow, the tear tape 53 is drawn out through the drawing opening portion W between the flanges 12*j*, 12*u* of the toner and developing frames 12*a*, 12*b* while tearing the cover film 52 (FIG. 12), thereby permitting the movement of the toner from the opening portion 12*i* of the toner frame 12*a* to the developing frame 12*b*.

Here, the drawing opening portion W is provided with the elastic seal material 47 for preventing leakage of toner and for sweeping the toner adhered to the tear tape 53 and the cover film 52 during the pulling of the tear tape 53. That is to say, in a condition after the tear tape 53 is drawn out through the drawing opening portion W between the flanges 12*j*, 12*u* of the toner and developing frames 12*a*, 12*b*, the elastic seal material (form polyurethane or the like) 47 having a thickness (non-compressed condition) t for preventing leakage of toner through the drawing opening portion W is secured to the flange 12*u* of the developing frame 12*b* by a both-face adhesive tape T. The elastic seal material 47 is compressed (in a thickness direction) between the flange 12*u* of the developing frame 12*b* and the flange 12*j* of the toner frame 12*a*, so that the compressed amount (=t−m) is maintained to a constant value by a uniform gap m between the flanges 12*j*, 12*u*.

In the toner leakage preventing mechanism having such a construction, in order to further enhance the weeping effect of the elastic seal material 47, if the compressed amount of the elastic seal material 47 is increased at the entire area between the flanges 12*j*, 12*u* of the toner and developing frames 12*a*, 12*b* (i.e., repelling force of the elastic seal material 47 is increased), the drawing force for the tear tape 53 will be increased or the developing frame 12*b* and the toner frame 12*a* joined at the upper and lower edges of the flanges 12*j*, 12*u* will be deformed to change the dimension, thereby worsening functions of other parts.

Further, when the tear tape 53 is drawn, if the folded portion 53*c* of the tear tape 53 or joined portion between the tear tape 53 and the cover film 52 or a peeled portion from the toner frame 12*a* penetrates between the elastic seal material 47 and the toner frame 12*a*, due to such penetration, the elastic seal material 47 will be damaged (i.e., turned over or torn), with the result that the toner leaks through such damaged portion.

VIII. Countermeasure for enhancement of toner sweeping function at drawing opening portion In the process cartridge according to the illustrated embodiment, in order to enhance the toner sweeping function of the elastic seal material 47 at the drawing opening portion W of the developing unit D, the compressed amount of the elastic seal material 47 compressed between the toner frame 12*a* and the developing frame 12*b* is varied along the drawing direction of the sheet member 54.

Now, such a construction will be fully explained with reference to FIGS. 7 to 10.

The elastic seal member 47 (FIG. 7) at the drawing opening portion W (FIG. 6) of the developing unit D is secured to an adhesion seat surface 12*ul* (fixed surface) of the flange 12*u* of the developing frame 12*b* by a both-face adhesive. The elastic seal material 47 is compressed (in the thickness direction) between the adhesion seat surface 12*ul* of the flange 12*u* of the developing frame 12*b* and the flange 12*j* of the toner frame 12*a* so that the thickness of the seal material becomes smaller than the non-compressed thickness t, and the compressed amount is determined by gaps m1, m2, m3 and n (FIG. 8) successively formed along the drawing direction of the tear tape 53. The gaps m1, m2, m3 and n are continuously provided along the drawing direction of the tear tape 53 between the adhesion seat surface 12*ul* of the developing frame 12*b* and the flange 12*j* of the toner frame 12*a*. More specifically, the gap m1 is provided on the longitudinal extension of the cover film 52 covering the opening portion 12*i*, the gap m2 is provided to be inclined toward the drawing direction of the tear tape 53, and the gaps m3, n are provided along the drawing direction of the tear tape 53.

Among these gaps m1, m2, m3 and n, the gaps m1, m2, m3 have the same dimension, and the gap n is smaller than the gaps m1, m2, m3. That is to say, in the illustrated embodiment, in order to prevent the deformation of the toner frame 12*a* and the developing frame 12*b* and to avoid increase in the drawing force of the tear tape 53, the compressed amounts of the elastic seal material 47 in the gaps m1, m2, m3 and n are steppingly increased along the drawing direction of the tear tape 53. Further, a relationship between the gaps m1, m2, m3, n and the original thickness t of the elastic seal material 47 is selected to t>m1=m2=m3>n. Further, the relationship (m1=m2=m3>n) between the gaps m1, m2, m3 and the gap n is provided by forming a transition portion (step) 60 (FIG. 9), from the gaps m1, m2, m3 to the gap n, on the adhesion seat surface 12*ul* of the developing frame 12*b*.

Although the dimensions of the gaps m1, m2, m3, n depends upon material property of the elastic seal material 47, when the elastic seal material 47 is made of usual foam polyurethane, generally, regarding the thickness t of the elastic seal member of 3 mm (T=3 mm), it is set to m1=m2=m3=1.2 to 1.5 mm, and n=0.5 to 1 mm.

Further, the transition portion 60 from the gaps m1, m2, m3 to the gap n formed by the adhesion seat surface 12*ul* of the developing frame 12*b* and the flange 12*j* of the toner frame 12*a* is concretely a step having a certain height which is connected to the adhesion seat surface 12*ul* via an inclined surface angled at 45° ($\pi/4$ rad) with respect to the drawing direction of the tear tape 53. The angle of the inclined surface of the step or transition portion 60 is not limited to 45°, but, when the elastic seal material 47 is adhered to the adhesion seat surface 12*ul* of the developing frame 12*b*, an inclined angle creating no clearance (i.e., 30° ($\pi/6$ rad) to 60° ($\pi/3$ rad)) may be used. Further, the step or transition portion 60 may be connected to the adhesion seat surface 12*ul* via a smooth R-arc surface so that the clearance is prevented from being created when the elastic seal material 47 is adhered to the adhesion seat surface 12*ul* of the developing frame 12*b*.

In the process cartridge B according to the illustrated embodiment, when the tear tape 53 is drawn in the direction shown by the arrow, the toner adhered to the tear tape 53 and the cover film 52 is firstly scraped by the gap portions m1, m2, m3 between the adhesion seat surface 12*ul* of the developing frame 12*b* and the flange 12*j* of the toner frame 12*a* and is ultimately swept by the gap portion n. In this way, the toner sweeping ability of the elastic seal material 47 is enhanced considerably. Further, since the compressed amount of the elastic seal material 47 is increased steppingly along the drawing direction of the tear tape 53, the drawing force of the tear tape 53 is not so increased.

Further, after the tear tape 53 was completely drawn out of the drawing opening portion W, if the toner is passed through the gap portions m1, m2, m3 due to vibration acting on the process cartridge B or a force created during the mounting and dismounting of the process cartridge B with respect to the main body 14 of the image forming apparatus, the toner can be sealed at the gap portion n.

In the case where the thickness t of the elastic seal material 47 of the developing unit D is 3 mm, if the gaps m1, m2, m3, n between the adhesion seat surface 12*ul* of the developing frame 12*b* and the flange 12*j* of the toner frame 12*a* are set to m1=m2=m3=n =0.5 to 1 mm, the repelling force of the elastic seal material 47 becomes too great, with the result that the toner frame 12*a* and the developing frame 12*b* joined together at the upper and lower edges of the flanges 12*j*, 12*u* by the ultrasonic welding are deformed to disorder the dimensional relationship, thereby worsening the functions of other parts constituting the developing unit D.

Further, in the case where the thickness t of the elastic seal material 47 of the developing unit D is 3 mm, if the gaps m1, m2, m3, n between the adhesion seat surface 12ul of the developing frame 12*b* and the flange 12*j* of the toner frame 12*a* are set to m1=m2=m3=n =0.5 to 1 mm and further an area of the elastic seal material 47 is selected not to deform the toner frame 12*a* and the developing frame 12*b*, the toner adhered to the tear tape 53 and the cover film 52 cannot be removed completely, with the result that the toner may leak out of the process cartridge B.

However, in the developing unit D of the process cartridge B according to the illustrated embodiment, since constructed as mentioned above, the above-mentioned inconveniences can be eliminated.

IX. Prevention of toner leakage due to turn-up or tearing of elastic seal material Next, an arrangement for preventing leakage of toner from the drawing opening portion W which may be caused by turn-up or tearing of the elastic seal material 47 will be explained with reference to FIG. 10.

Figure 10:
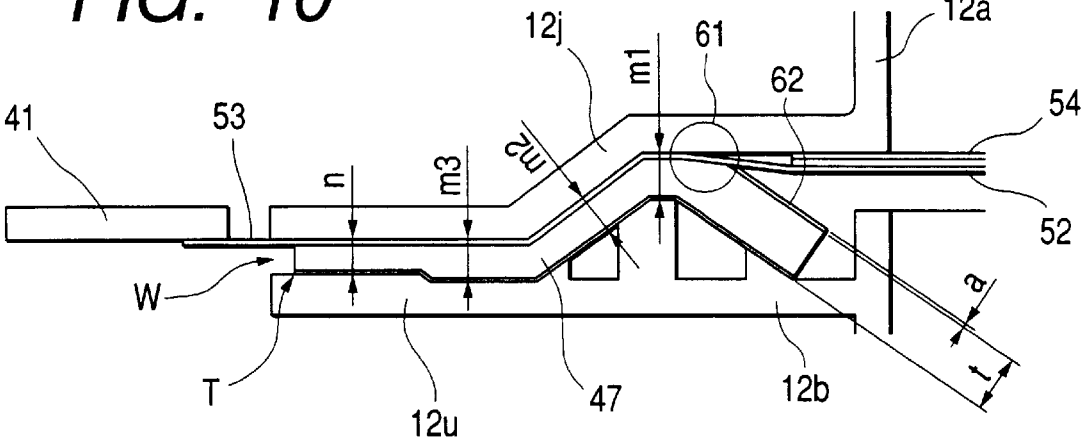
FIG. 10 is sectional view showing an unsealable opening portion of a process cartridge before a tear tape is pulled out.

As shown in FIG. 10, in the elastic seal material 47, a sheet member 62 having good sliding ability and formed as a thin plate from PET (polyethylene terephthalate) or HDPE (high density polyethylene) is provided in a entrance portion 61 into which the tear tape 53 is firstly entered when the tear tape 53 is drawn. That is to say, coefficient of friction between the sheet member 62 and the tear tape 53 is smaller than coefficient of friction between foam polyurethane (elastic seal material) and the tear tape 53. More specifically, the sheet member 62 is provided on the surface of the elastic seal material 47 opposed to the toner frame 12*a* through a range from an end near the cover film 52 to the gap m1 provided on a longitudinal extension of the cover film 52. Incidentally, "a" indicates a thickness of the sheet member 62.

In this way, by providing the sheet member 62 having low coefficient of friction in the entrance portion 61 of the elastic seal material 47 into which the tear tape 53 is firstly entered, when the tear tape 53 is drawn from the drawing opening portion W, the tear tape 53 is firstly contacted with the sheet member 61 at the entrance portion 61. Since the sheet member 62 has good sliding ability, even if the folded portion 53*c* of the tear tape 53 or joined portion between the tear tape 53 and the cover film 52 or a peeled portion from the toner frame 12*a* penetrates into the entrance portion 61, the sliding resistance force can be reduced in the entrance portion 61. Thus, when the tear tape 53 and the cover film 52 are drawn out, the elastic seal material 47 can be prevented from being turned up or torn. As a result, leakage of toner from the drawing opening portion W which may be caused by turn-up or tearing of the elastic seal material 47 can be prevented.

Other Embodiments

In the process cartridge B according to the illustrated embodiment, while an example that the elastic seal material 47 is adhered to the flange 12*u* of the developing frame 12*b* was explained, the elastic seal material 47 may be adhered to the flange 12*j* of the toner frame 12*a*.

Further, while an example that the process cartridge B serves to form a monochromatic image was explained, the present invention can be applied to the process cartridge B serves to form a monochromatic image, but also a process cartridge in which a plurality of developing means are provided and a plural color image (for example, two-color image, three-color image or full-color image) is formed.

As a developing method, a known two-component magnet brush developing method, a cascade developing method, a touch-down developing method cloud developing method or the like may be used.

Further, the electrophotographic photosensitive member is not limited to the photosensitive drum, but, for example, the followings may be included. First of all, photo-electric body is used as the photosensitive body, and the photo-electric body may be amorphous silicon, amorphous selenium, zinc oxide, titanium oxide or organic photoconductor (OPC). Further, a member on which the photosensitive body is mounted may be a drum, belt-shaped rotary member, sheet-shaped rotary member, or the like. Incidentally, the drum or the belt is generally used, and, for example, in the drum-type photosensitive member, photoconductor is deposited or coated on an aluminum alloy cylinder.

In the first embodiment, while an example that the charging means of so-called contact charging type is used was explained, as another construction, a conventional arrangement in which three walls made of tungsten wires are shielded by a metallic shield made of aluminum and positive or negative ions generated by applying high voltage to the tungsten wires are shifted to a surface of a photosensitive drum, thereby uniformly charging the surface of the photosensitive drum may be used.

Incidentally, the charging means may be of blade type (charging blade), pad type, block type, rod type, wire type or the like, as well as the roller type.

In a method for cleaning the residual toner from the photosensitive drum, a fur brush, a magnet brush or the like may be used as cleaning means, as well as the cleaning blade.

Material of the toner frame 12*a* and the developing frame 12*b* may be plastic such as polystyrene, ABS resin (acrylonitrile-butadiene-styrene copolymer), denaturated PPE resin (polyphenylene ether), denaturated PPO resin (polyphenylene ixide), polycarbonate, polyethylene or polypropylene.

Further, the process cartridge incorporates therein an image bearing member and at least one process means. Accordingly, as well as the process cartridge according to the illustrated embodiment, the process cartridge may incorporate therein an electrophotographic photosensitive member (image bearing member), developing means and charging means as a cartridge unit which is detachably attachable to a main body of an image forming apparatus, or may incorporate therein an electrophotographic photosensitive member and developing means as a cartridge unit which is detachably attachable to a main body of an image forming apparatus, or may incorporate therein an electrophotographic photosensitive member, developing means and cleaning means as a cartridge unit which is detachably attachable to a main body of an image forming apparatus.

That is to say, the process cartridge may incorporate therein an electrophotographic photosensitive member, developing means and at least one of charging means and cleaning means as a cartridge unit which is detachably attachable to a main body of an image forming apparatus.

And, the process cartridge can be mounted and dismounted with respect to the main body of the image forming apparatus by the operator himself. Thus, the maintenance of the main body of the image forming apparatus can be performed by the operator himself.

Further, in the above-mentioned embodiment, while an example that the electrophotographic image forming apparatus is a laser beam printer was explained, the present invention is not limited to such an example, but, for example, the present invention can be applied to other image forming apparatus such as an electrophotographic copying machine, a facsimile apparatus or a word processor.

What is claimed is:

1. A developing apparatus comprising:

a developer bearing member for bearing developer to develop an electrostatic image formed on an image bearing member with the developer;

a developing frame for supporting said developer bearing member;

a developer containing frame containing the developer and having a supply opening for supplying the developer to said developing frame and joined to said developing frame;

an unsealable sheet member covering said supply opening; and an elastic seal member provided at a drawing opening portion formed between said developing frame and said developer containing frame and through which said sheet member is drawn, said seal member being capable of being urged against said sheet member when said sheet member is drawn and sealing said drawing opening portion after said sheet member was drawn;

wherein a deformed amount of said seal member is varied along a drawing direction of said sheet member.

2. A developing apparatus according to claim 1, wherein the deformed amount of said seal member is greater at a portion near outer side of said developing frame than at a portion remote from the outer side, in the drawing direction of said sheet member.

3. A developing apparatus according to claim 1, wherein said seal member is secured to said developing frame.

4. A developing apparatus according to claim 1, wherein a distance between said developing frame and said developer containing frame at a position where said seal member is provided is varied along the drawing direction of said sheet member.

5. A developing apparatus according to claim 2, wherein a distance between said developing frame and said developer containing frame at a position where said seal member is provided is smaller at the portion near the outer side of said developing frame than at the portion remote from the outer side, in the drawing direction of said sheet member.

6. A developing apparatus according to claim 3, wherein a surface of said developing frame to which said seal member is secured has a transition portion so that the deformed amount of said seal member is varied along the drawing direction of said sheet member.

7. A developing apparatus according to claim 3, wherein a surface of said developing frame to which said seal member is secured has a stepped portion so that the deformed amount of said seal member is varied along the drawing direction of said sheet member.

8. A developing apparatus according to claim 7, wherein said stepped portion is connected by an inclined surface angled at 30° to 60° or an arc surface.

9. A developing apparatus according to claim 1, wherein said seal member has a first portion which is firstly contacted with said sheet member, and a second portion which is subsequently contacted with said sheet member, and said first portion has a smaller coefficient of friction than that of said second portion with respect to said sheet member.

10. A developing apparatus according to claim 9, wherein said first portion is made of polyethylene terephthalate or high density polyethylene.

11. A developing apparatus according to claim 1, wherein said seal member includes a foam body.

12. A developing apparatus according to any one of claims 1 to 11, wherein the developing apparatus constitutes, together with said image bearing member bearing an image, a process cartridge detachably attachable to a main body of an image forming apparatus.

* * * * *